US011746620B2

(12) United States Patent
Nudo

(10) Patent No.: US 11,746,620 B2
(45) Date of Patent: Sep. 5, 2023

(54) INJECTION VALVE, SYSTEM AND METHOD

(71) Applicant: Nicholas Nudo, Houston, TX (US)

(72) Inventor: Nicholas Nudo, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 40 days.

(21) Appl. No.: 17/357,079

(22) Filed: Jun. 24, 2021

(65) Prior Publication Data

US 2022/0412187 A1 Dec. 29, 2022

(51) Int. Cl.
*E21B 34/10* (2006.01)
*E21B 43/12* (2006.01)

(52) U.S. Cl.
CPC ..... *E21B 34/10* (2013.01); *E21B 43/12* (2013.01)

(58) Field of Classification Search
CPC ..... E21B 34/10; E21B 43/12; E21B 34/101
See application file for complete search history.

(56) References Cited

U.S. PATENT DOCUMENTS 5,156,220 A * 10/1992 Forehand ..... E21B 34/14 166/332.7
5,316,084 A * 5/1994 Murray ..... E21B 33/1208 166/387
6,371,208 B1 * 4/2002 Norman ..... E21B 34/06 166/334.4
7,363,981 B2 4/2008 Coon et al.
7,445,047 B2 * 11/2008 Gomez ..... E21B 34/14 277/342
7,455,115 B2 * 11/2008 Loretz ..... E21B 43/14 166/334.1
7,921,915 B2 * 4/2011 Richard ..... E21B 43/08 166/334.4
8,827,238 B2 * 9/2014 Geddes ..... E21B 34/101 251/126
9,441,468 B1 * 9/2016 Pryor ..... E21B 43/124
9,920,601 B2 * 3/2018 Carrejo ..... E21B 43/12
10,400,559 B2 * 9/2019 Webber ..... E21B 34/14
11,002,103 B2 * 5/2021 Vasques ..... E21B 34/06
11,306,562 B1 * 4/2022 Giroux ..... E21B 34/142
2003/0183392 A1 * 10/2003 Garay ..... E21B 34/06 166/334.1
2007/0089887 A1 * 4/2007 Gomez ..... E21B 34/14 166/334.4
2014/0224496 A1 * 8/2014 Nguyen ..... E21B 34/10 166/334.4
2018/0328496 A1 * 11/2018 Nguyen ..... F16K 3/265

* cited by examiner

*Primary Examiner* — D. Andrews
(74) *Attorney, Agent, or Firm* — CANTOR COLBURN LLP

(57) ABSTRACT

An injection valve including a housing having a port, an insert movably disposed in the housing, a seal and a diffuser disposed on the insert, the seal and diffuser being movable with the insert. A method for injecting in a borehole including pumping fluid into the borehole, pressurizing an inside diameter of an insert of an injection valve, moving the insert of the injection valve to a position that is not fully closed, diffusing fluid flowing from the inside diameter of the insert; and then flowing the diffused fluid past a seal on the insert.

15 Claims, 3 Drawing Sheets

INJECTION VALVE, SYSTEM AND METHOD

BACKGROUND

In the resource recovery and fluid sequestration industries, there is often a need to open valves that are disposed across a pressure differential that is sufficient to cause flow cutting of seals in the valve at the moment of cracking. Such flow cutting is a significant problem for the identified industries since it reduces service life of such valves and increases costs for the operations that use them. While efforts have been somewhat successful in reducing the problem for production valves, structural constraints have made advances difficult in the injection valve space. Injections valves thus suffer worse flow cutting, reduced service life, increased maintenance and higher cost of operation. The arts noted would well receive new arrangements that avoid these drawbacks.

SUMMARY

An injection valve including a housing having a port, an insert movably disposed in the housing, a seal and a diffuser disposed on the insert, the seal and diffuser being movable with the insert.

A method for injecting in a borehole including pumping fluid into the borehole, pressurizing an inside diameter of an insert of an injection valve, moving the insert of the injection valve to a position that is not fully closed, diffusing fluid flowing from the inside diameter of the insert; and then flowing the diffused fluid past a seal on the insert.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
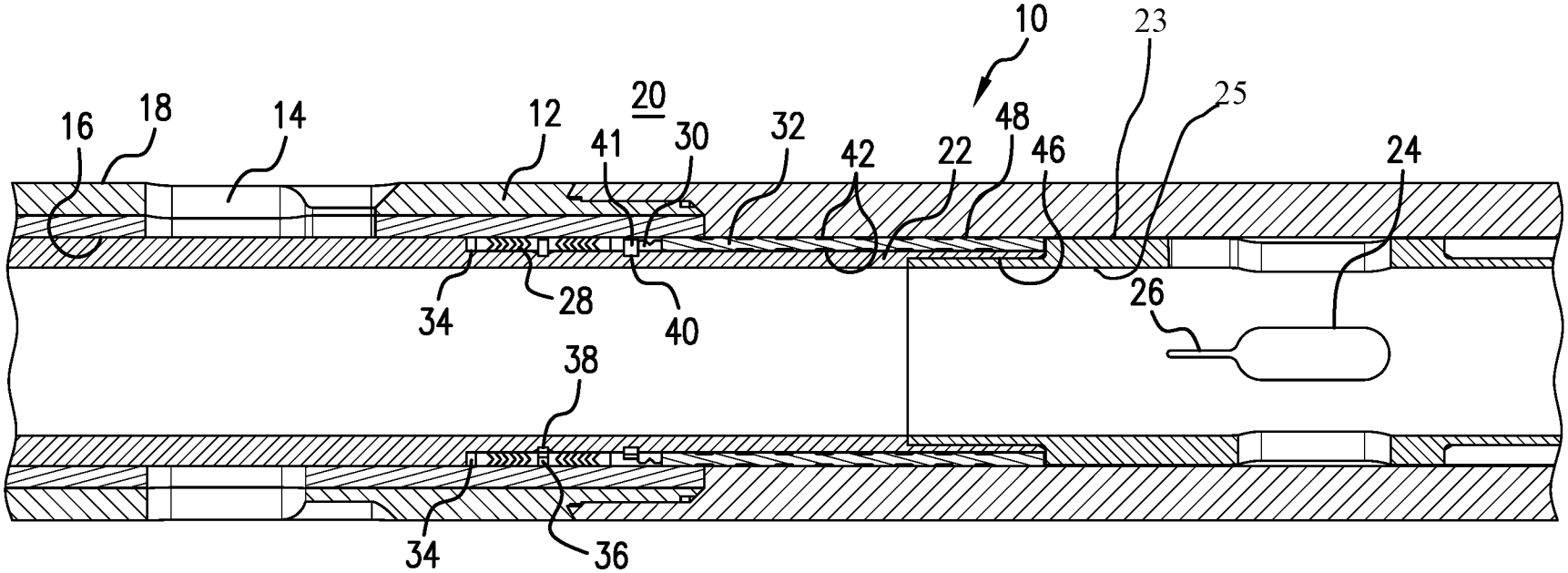
FIG. 1 is a cross sectional view of an embodiment of an injection valve as disclosed herein in a closed position.
Figure 2:
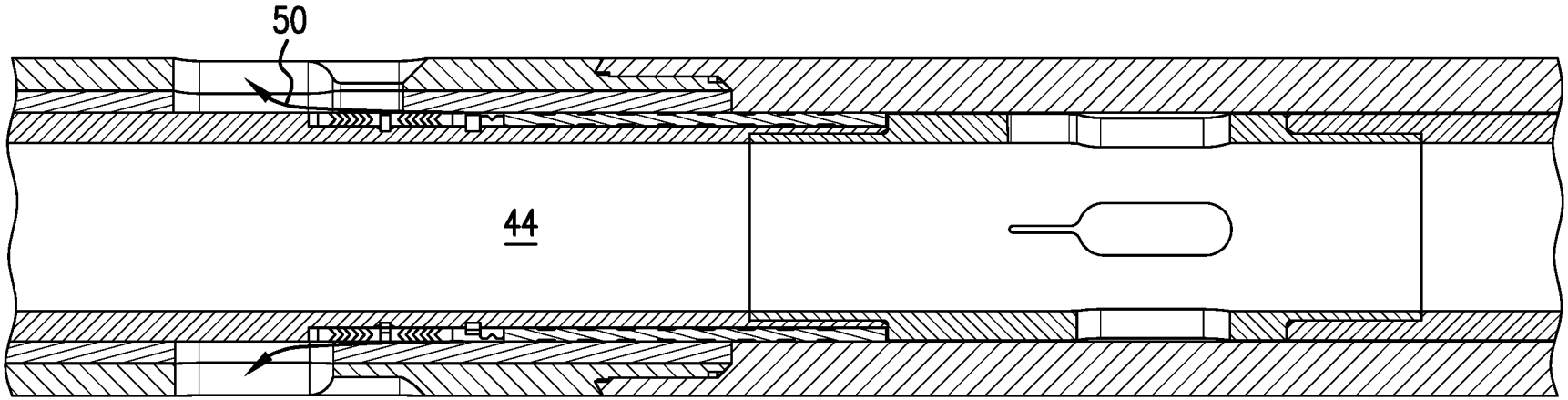
FIG. 2 is a cross sectional view of the injection valve illustrated in FIG. 1 in an open position.

Referring to FIGS. 1 and 2, an injection valve 10 is illustrated in cross section. The valve 10 includes a housing 12 having a port 14 therein that extends from an inside diameter surface 16 of the housing to an outside surface 18 of the housing. The port 14 is fluidly connected to an annular space 20 outside of the housing 12 such as an annulus of a wellbore system 60. Where the housing 12 includes more than one sub, it may be desirable to use premium seal threads at the threaded connection to prevent fluid flow therethrough.

Disposed within the housing 12 is an insert 22. The insert 22 is movable at least longitudinally of the housing 12 such that it may be positioned as desired between a valve closed position (FIG. 1) and a valve open position (FIG. 2). It should be noted that the position is not binary but rather can be a closed position and any other position between fully closed and fully open. This is done by shifting the insert 22 relative to housing 12 by mechanical, hydraulic, etc. means.

The insert 22 includes an opening 24 that may include a lead orifice 26, each extending from an outside surface 23 of the insert 22 to an inside surface 25 of the insert. The insert 22 supports a seal 28, a ring 30 and a diffuser 32 thereon. Each of the seal 28, ring 30 and diffuser 32, since they are mounted to the insert 22 will move with the insert 22 when the insert 22 is shifted. The seal 28 is disposed against a shoulder 34 of the insert 22, which serves to maintain the seal in place while under differential pressure. The shoulder is also the result of creating a small recess for the seal 28. In an embodiment, it is advantageous to configure the outside diameter of the seal to be identical or very close to identical to an outside diameter of any other seals (not shown) employed on the insert of the injection valve 10 or to an inside diameter of any other seals employed in the housing of the injection valve that are also exposed to either tubing or annulus pressure. Put another way, seal surfaces that act dynamically on a different component (insert or housing) within the injection valve 10 should have the same diameter. This will prevent any differential pressure acting on the seal 28 that might otherwise cause inadvertent shifting of the insert 22. Optionally, the insert may also include a retainer member 36 that assists in maintaining the position of seal 28 by extending radially inwardly into a retainer recess 38 in insert 22. Retainer 36 also assists in absorbing load from a higher-pressure side of seal 28 and preventing crushing in the lower-pressure side of the seal 28. Further a groove 40 is disposed in the insert 22 to receive a C-ring 41 or similar that will locate the ring 30. The ring 30 may be of a PEEK (Polyether Ether Ketone) material or other similar material and has for its purpose to assist in fluid flow diffusion. Adjacent the ring 30 is a diffuser 32, that may be a ceramic material or other erosion resistant material. The diffuser 32 may have flow profiles 42 in one or both of diffuser inside surface 46 or diffuser outside surface 48 that are configured to create a pressure drop in fluid flowing across the diffuser.

In use, the injection valve 10 provides substantial benefit to the art in that it provides for a long service life and low maintenance cost due to the fact that the seal 28 is protected from flow cutting during cracking of the valve 10 to allow fluid to exit the valve 10 under a pressure differential. This is because the seal 28 remains positioned downstream of the diffuser 32 in the flow path from the inside diameter of the insert through the valve 10 to the annulus 20. This can be seen in FIG. 2 where the insert 22 has been shifted enough to position the seal 28 radially inwardly of the port 14 thereby allowing fluid from the more highly pressurized inside diameter volume 44 (tubing ID in vernacular) to flow past seal 28 and through port 14. An arrow 50 illustrates the flow past the seal 28 but it will be understood that the path begins in the ID 44 and proceeds through opening 24, diffuser 32, ring 30 and out port 14. Therefore a method for injecting fluid into the annulus of a borehole includes pressurizing fluid in the ID 44, shifting the insert 22 to move the seal 28 under port 14 and flowing fluid from the ID 44 through opening 24, through diffuser 32 and over ring 30 whereby the flowing fluid is well diffused such that as it flows over seal 28, flow cutting will be reduced or eliminated relative to attempting this operation with a prior art valve.

Figure 3:
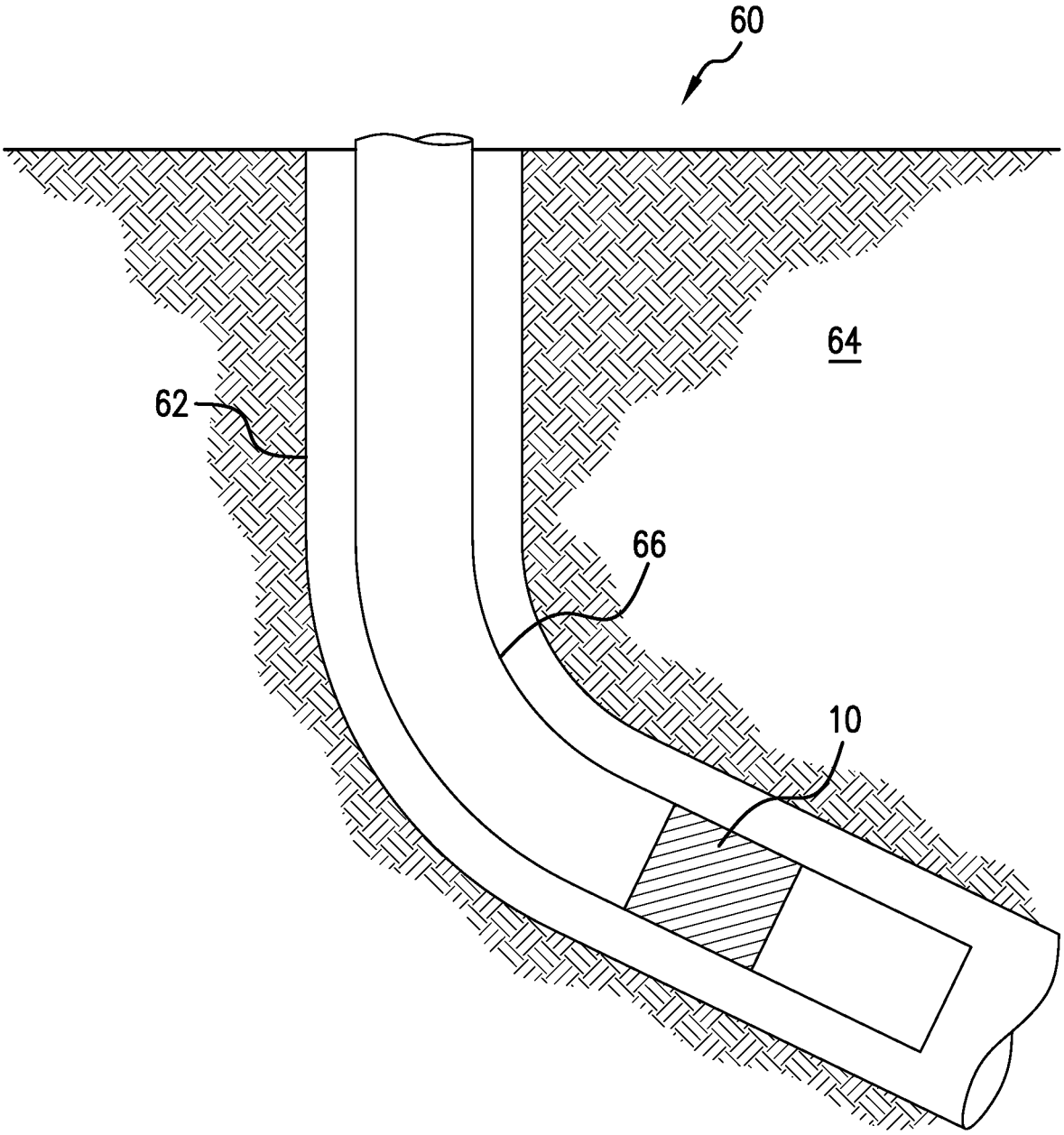
FIG. 3 is a view of a wellbore system including the injection valve disclosed herein.

Referring to FIG. 3, the wellbore system 60 comprises a borehole 62 in a subsurface formation 64. A string 66 is disposed in the borehole 62, and an injection valve 10 is disposed within or as a part of the string 66.

Set forth below are some embodiments of the foregoing disclosure:

Embodiment 1: An injection valve including a housing having a port, an insert movably disposed in the housing, a seal and a diffuser disposed on the insert, the seal and diffuser being movable with the insert.

Embodiment 2: The injection valve as in any prior embodiment, wherein the diffuser is positioned along a flow path of the injection valve nearer to an inside diameter of the insert than the seal.

Embodiment 3: The injection valve as in any prior embodiment, wherein the insert includes a shoulder to locate the seal.

Embodiment 4: The injection valve as in any prior embodiment, further comprising a retainer member in operative engagement with the seal, the retainer member anchored to the insert in a retainer recess.

Embodiment 5: The injection valve as in any prior embodiment, further comprising a ring disposed adjacent the diffuser to assist in flow diffusion.

Embodiment 6: The injection valve as in any prior embodiment, wherein the diffuser includes a profile on one of an inside diameter surface, an outside diameter surface or both an inside diameter surface and an outside diameter surface.

Embodiment 7: The injection valve as in any prior embodiment, wherein the insert is movable between a fully closed position, and a number of part open positions, and a fully open position.

Embodiment 8: A method for injecting in a borehole including pumping fluid into the borehole, pressurizing an inside diameter of an insert of an injection valve, moving the insert of the injection valve to a position that is not fully closed, diffusing fluid flowing from the inside diameter of the insert; and then flowing the diffused fluid past a seal on the insert.

Embodiment 9: The method as in any prior embodiment, further comprising moving the seal with the insert.

Embodiment 10: The method as in any prior embodiment, further comprising moving the diffuser with the insert.

Embodiment 11: The method as in any prior embodiment, further comprising flowing diffused fluid about a diffusion assist ring.

Embodiment 12: The method as in any prior embodiment, wherein the diffusing is flowing fluid over a diffuser.

Embodiment 13: The method as in any prior embodiment, wherein the diffusing is over an outside diameter surface of the diffuser.

Embodiment 14: The method as in any prior embodiment, wherein the diffusing is over an inside diameter surface of the diffuser.

Embodiment 15: The method as in any prior embodiment, wherein the diffusing is over an inside diameter surface of the diffuser.

Embodiment 16: A wellbore system including a borehole in a subsurface formation, a string in the borehole, an injection valve as in any prior embodiment, within or disposed as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An injection valve comprising:

a housing having a port;

an insert movably disposed in the housing and having an opening having a lead orifice, the opening and lead orifice extending from an outside surface of the insert to an inside surface of the insert;

a seal and a diffuser disposed on the insert and in contact with the housing, the seal and diffusers being movable with the insert in the housing wherein the insert is movable between a fully closed position, and a number of part open positions, and a fully open position.

2. The injection valve as claimed in claim 1 wherein along a flow path between the port and the opening, the diffuser is positioned nearer to the opening than the seal.

3. The injection valve as claimed in claim 1 wherein the insert includes a shoulder to locate the seal.

4. The injection valve as claimed in claim 1 further comprising a retainer member in operative engagement with the seal, the retainer member anchored to the insert in a retainer recess.

5. The injection valve as claimed in claim 1 further comprising a ring disposed adjacent the diffuser to assist in flow diffusion.

6. The injection valve as claimed in claim 1 wherein the diffuser includes a profile defining a flow path on an inside diameter surface of the diffuser, and a profile defining a separate flow path on an outside diameter surface of the diffuser.

7. A method for injecting in a borehole comprising:

pumping fluid into the borehole;

pressurizing an inside diameter of the insert of the injection valve as claimed in claim 1;

moving the insert of the injection valve to a position that is not fully closed;

diffusing fluid flowing from the inside diameter of the insert; and then flowing the diffused fluid past a seal on the insert.

8. The method as claimed in claim 7 further comprising moving the seal with the insert.

9. The method as claimed in claim 7, wherein the diffusing is by flowing fluid through a diffuser, the method further comprising moving the diffuser with the insert.

10. The method as claimed in claim 7 further comprising flowing diffused fluid about a diffusion assist ring.

11. The method as claimed in claim 7 wherein the diffusing is flowing fluid over a diffuser.

12. The method as claimed in claim 11 wherein the diffusing is over an outside diameter surface of the diffuser.

13. The method as claimed in claim 12 wherein the diffusing is over an inside diameter surface of the diffuser.

14. The method as claimed in claim 11 wherein the diffusing is over an inside diameter surface of the diffuser.

15. A wellbore system comprising:

a borehole in a subsurface formation;

a string in the borehole;

an injection valve as claimed in claim 1 within or disposed as a part of the string.

* * * * *